US006737228B2

(12) United States Patent
Elst et al.

(10) Patent No.: US 6,737,228 B2
(45) Date of Patent: May 18, 2004

(54) FILM MATERIAL EXHIBITING A "COLDER" BLUE-BLACK IMAGE TONE AND IMPROVED PRESERVATION CHARACTERISTICS

(75) Inventors: Kathy Elst, Kessel (BE); Johan Loccufier, Zwijnaarde (BE)

(73) Assignee: AGFA-Gevaert, Mortsel (BE)

( * ) Notice: Subject to any disclaimer, the term of this patent is extended or adjusted under 35 U.S.C. 154(b) by 6 days.

(21) Appl. No.: 10/150,329

(22) Filed: May 16, 2002

(65) Prior Publication Data

US 2002/0197569 A1 Dec. 26, 2002

Related U.S. Application Data

(60) Provisional application No. 60/308,290, filed on Jul. 27, 2001.

(30) Foreign Application Priority Data

May 22, 2001 (EP) ..... 01000178

(51) Int. Cl.[7] ..... G03C 1/035; G03C 1/34

(52) U.S. Cl. ..... 430/502; 430/139; 430/567; 430/611; 430/965; 430/966

(58) Field of Search ..... 430/502, 139, 430/567, 569, 611, 964, 965

(56) References Cited

U.S. PATENT DOCUMENTS

| | | | | |
|---|---|---|---|---|
| 4,696,894 A | | 9/1987 | Deguchi et al. | 430/551 |
| 5,229,249 A | | 7/1993 | Katoh et al. | 430/264 |
| 5,494,789 A | * | 2/1996 | Daubendiek et al. | 430/567 |
| 5,612,176 A | * | 3/1997 | Eshelman et al. | 430/567 |
| 5,629,144 A | | 5/1997 | Daubendiek et al. | 430/567 |
| 5,759,759 A | * | 6/1998 | Adin et al. | 430/567 |
| 5,811,229 A | * | 9/1998 | Van den Zegel | 430/517 |

FOREIGN PATENT DOCUMENTS

| | | | |
|---|---|---|---|
| EP | 542354 | * | 11/1991 |
| EP | 677773 | * | 10/1995 |
| EP | 911687 | * | 4/1999 |
| EP | 933670 | * | 8/1999 |
| EP | 1103847 | * | 5/2001 |
| EP | 1103849 | * | 5/2001 |
| JP | 1-260441 | * | 10/1989 |
| JP | 5-341415 | | 12/1993 |
| JP | 10-062920 | * | 3/1998 |

OTHER PUBLICATIONS

English language abstract for JP 10–062920.*

Research Disclosure 36544, section XVIII, A. 9–1994.*

(List continued on next page.)

*Primary Examiner*—Janet Baxter
*Assistant Examiner*—Amanda C. Walke
(74) *Attorney, Agent, or Firm*—Joseph T. Guy; Nexsen Pruet, LLC

(57) ABSTRACT

A black-and-white silver halide photographic film material has been provided, wherein said material has first and second major surfaces, at least one of which is coated with at least one light-sensitive silver halide emulsion layer, overcoated with a protective antistress layer, wherein said emulsion layer(s) have chemically and spectrally sensitized {111} tabular hexagonal emulsion grains or crystals rich in silver bromide in an amount covering at least 50% of the total projective grain surface of all grains, wherein said grains further have an average equivalent volume diameter in the range from 0.3 $\mu$m up to 1.5 $\mu$m and an average grain thickness of less than 0.30 $\mu$m, and an average amount of iodide from 0.05 mole % up to 0.5 mole % based on silver over the whole grain volume, characterized in that said material comprises, in an amount of at least 0.5 mmole per mole of silver halide coated, a heteroaromatic compound according to the general formula (I), presented in the claims and in the detailed description.

28 Claims, 2 Drawing Sheets

U.S. PATENT DOCUMENTS 6,033,840 A * 3/2000 Dickerson ..... 430/502
6,045,984 A * 4/2000 Hoshino ..... 430/504
6,048,096 A * 4/2000 Verbeeck et al. ..... 378/182
6,280,922 B1 * 8/2001 Lok ..... 430/611
6,342,338 B1 * 1/2002 Verbeeck et al. ..... 430/502
6,346,360 B1 * 2/2002 Verbeeck et al. ..... 430/139
6,348,293 B1 * 2/2002 Verbeeck et al. ..... 430/139
6,403,276 B1 * 6/2002 Elst et al. ..... 430/139
6,472,137 B1 * 10/2002 Verbeeck et al. ..... 430/567
6,528,227 B2 * 3/2003 Van den Zegel et al. ... 430/139
2002/0037485 A1 * 3/2002 Elst et al. ..... 430/567
2002/0076640 A1 * 6/2002 Zegel et al. ..... 430/139
2002/0127503 A1 * 9/2002 Elst et al. ..... 430/567

* cited by examiner

7 lasers in parallel:
T1,...,T7 laser times may differ

FILM MATERIAL EXHIBITING A "COLDER" BLUE-BLACK IMAGE TONE AND IMPROVED PRESERVATION CHARACTERISTICS

This application claims benefit of Provisional Serial No. 60/308,290 filed Jul. 27, 2001.

FIELD OF THE INVENTION

The present invention relates to a light-sensitive silver halide photographic film material, and, more particularly a radiographic material suitable for use in combination with one or two intensifying screens having luminescent phosphors, wherein said film material comprises, in the light-sensitive emulsion layers, tabular hexagonal {111} silver halide grains.

BACKGROUND OF THE INVENTION

Since the early eighties practical use of light-sensitive tabular silver halide grains or crystals has become common knowledge for anyone skilled in the art of photography. From Eastman Kodak's basic patents relied thereupon those related with the preparation of {111} tabular silver halide grains, sensitivity increase by spectral and chemical sensitization, and coating in a light-sensitive silver halide photographic material, more particularly in a forehardened duplitized radiographic material showing improved covering power for tabular grains having a thickness of less than 0.20 $\mu$m as described in U.S. Pat. No. 4,414,304 and in the patents corresponding therewith in Japan and in the European countries, it becomes clear that problems encountered by making use of such grains are related with image tone and developability as has also been set forth in U.S. Pat. No. 5,595,864.

In radiographic applications the film materials are coated with relatively high amounts of silver, in order to provide a suitable sensitometry even if a low radiation dose is applied to the patient as is always desirable. Although the use of {111} tabular silver halide grains permits coating of lower amounts of silver, if compared e.g. with grains having a more globular shape as applied before practical application of said tabular grains, there remains the need to provide an acceptable image tone after development of materials having light-sensitive silver halide layers containing said tabular grains. Reduction of thickness of the {111} tabular grains coated in a radiographic film material hitherto, although providing a higher covering power, remains unambiguously related indeed with the occurrence, after processing of such materials, of diagnostic images having an unacceptable reddish-brown image tone for radiologists as image tone and image quality are closely related with each other in the specific context of examination of diagnostic images. Measures taken in order to get a shift in image tone from reddish-brown to the desired bluish-black colour of the developed silver, well-known from the state-of-the-art are hitherto unsatisfactory. Coating light-sensitive emulsion layers on a blue base as in U.S. Pat. No. 5,800,976 makes increase minimum density, a phenomenon which is interpreted by the radiologist as an undesired increase of "fog density". Incorporation in the other layers of the film material of such dyes or dye precursors providing blue colour directly or indirectly (by processing and oxidative coupling reactions) are e.g. known from U.S. Pat. Nos. 5,716,769 and 5,811,229 and EP-A 0 844 520, and JP-A 10-274 824 respectively and causes the same problems as set forth hereinbefore, moreover showing, in the worst cases, staining of the screens with blue dyes diffusing from the material onto the screen, with residual colour of dyes due to uncomplete removal of said dyes in, nowadays desired, rapid processing steps and problems related with criticality of generation of imagewise developed blue coloured silver and preservation characteristics of the material.

Radiographic elements exhibiting increased covering power and colder image tones have been published in U.S. Pat. Nos. 5,795,795; 5,800,976 and 5,955,249.

More recently very effective measures in order to improve image tone have been described in EP-Applications Nos. 00203914, 00203916, 00203917, 00203918, simultaneously filed Nov. 7, 2000.

Apart from an improved image tone it has always been an important goal to have stable materials: preservation of said materials in severe circumstances with respect to heat and humidity before exposure remains important.

To summarize: the stringent demand remains to get a desired blue-black image tone of a diagnostic image without disturbing residual color obtained after processing of the radiographic light-sensitive silver halide film material, wherein the said material has suitable preservation characteristics before use.

OBJECTS OF THE INVENTION

It is a first object of the present invention to provide a better image tone after processing of a light-sensitive silver halide film material having tabular grain emulsions.

It is a second object of the present invention to provide improved preservation of the material before exposure.

Further objects will become apparent from the description hereinafter.

BRIEF DESCRIPTION OF THE DRAWINGS

Figures hereinafter are related with laser marking concepts for photosensitive materials of the present invention as will further be explained in the detailed description hereinafter.

SUMMARY OF THE INVENTION

Figure 1:
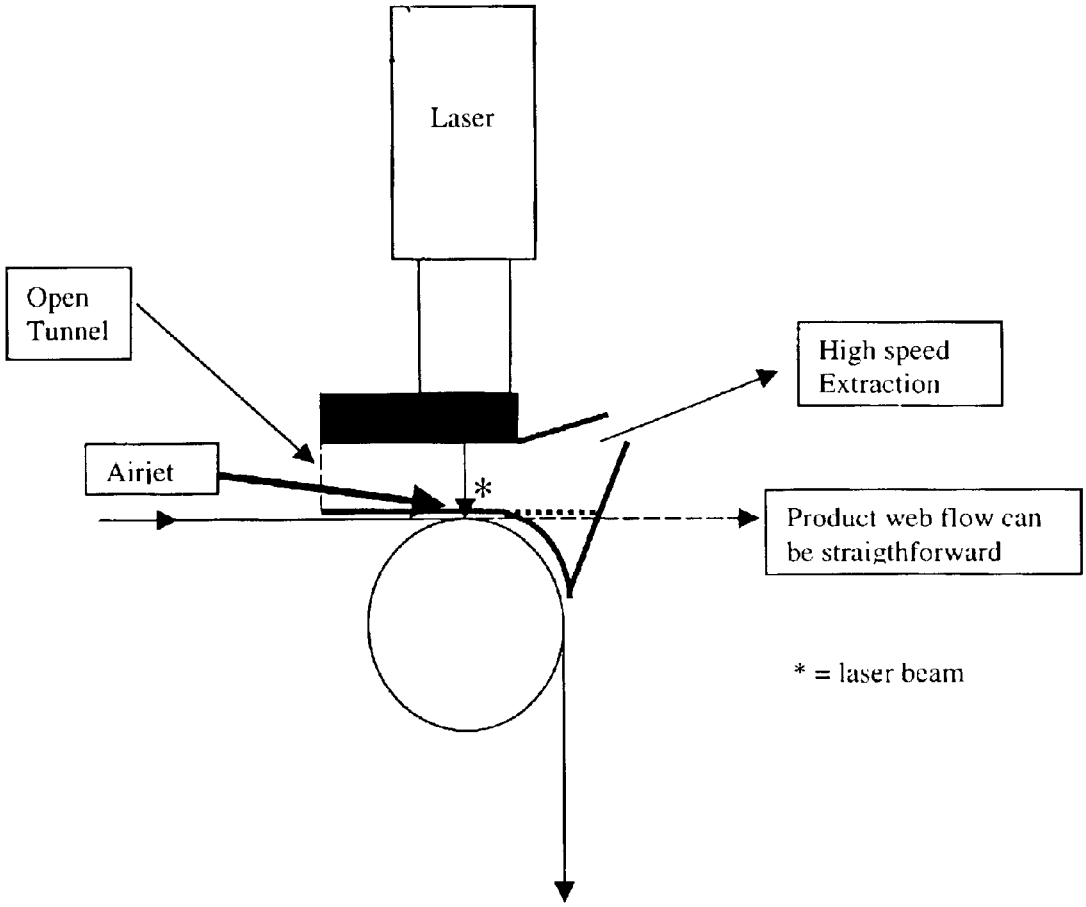
FIG. 1 is illustrative for a laser marking process with an "open tunnel".

The above mentioned objects to improve preservation characteristics before use and image tone of the processed material after exposure have, unexpectedly, simultaneously been realized both by providing a light-sensitive silver halide photographic film material, wherein said material has first and second major surfaces, at least one of which is coated with at least one light-sensitive silver halide emulsion layer, overcoated with a protective antistress layer, said light-sensitive emulsion layer(s) having {111} tabular grains or crystals rich in silver bromide in an amount covering at least 50% of the total projective grain surface of all grains, wherein said grains further have an average equivalent volume diameter in the range from 0.3 μm up to 1.5 μm and an average grain thickness of less than 0.30 μm, and an average amount of iodide from 0.05 mole % up to 0.5 mole % based on silver over the whole grain volume, characterized in that said material comprises, in an amount of at least 0.5 mmole per mole of silver halide coated, a heteroaromatic compound according to the general formula (I). More particularly presence of said compound in high amounts of from 1 up to 5 mmole per mole of silver halide coated in the (radiographic) film material is preferred.

Specific features for preferred embodiments of the invention are set out in the dependent claims.

Further advantages and embodiments of the present invention will become apparent from the following description.

DETAILED DESCRIPTION OF THE INVENTION

According to the present invention a light-sensitive silver halide photographic film material is thus disclosed, said material comprising on one or both sides of the support at least one light-sensitive silver halide emulsion layer overcoated with a protective antistress layer, said light-sensitive emulsion layer(s) having {111} tabular grains or crystals rich in silver bromide in an amount covering at least 50% of the total projective grain surface of all grains, characterized in that said protective layer, said light-sensitive layer(s) or both said protective layer and said light-sensitive layer(s) comprise, in an amount of at least 0.5 mmole per mole of silver halide coated, a heteroaromatic compound according to general formula (I):

(I)

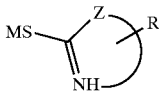

wherein

M represents a hydrogen or an element providing a counterion;

Z represents atoms required in order to form a five- or six-membered heteroaromatic ring; and R represents a substituent representing an amino-ether or amino-alcohol, provided that R is not part of an azacrown ether.

In a more preferred the heteroaromatic compound is a five membered heteroaromatic compound. In an even more preferred embodiment, the five membered heteroaromatic compound is selected from the group consisting of a tetrazole, a thiadiazole, a triazole, a (benz)imidazole, a (benz)thiazole and a (benz)oxazole, with tetrazoles, thiadiazoles and triazoles being particularly preferred.

Preferred amino-ether or amino-alcohol substituents comprise a ternary amine. In an even more preferred embodiment, the amino-ether or amino-alcohol substituent is characterized by general formula (II):

(II)

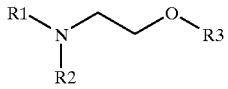

wherein R1 and R2 each independently represents an unsubstituted or substituted aliphatic chain and R3 represents hydrogen or an unsubstituted or substituted aliphatic chain. All of the R1, R2 and R3-groups may each, independently, form a ring. In a most preferred embodiment R comprises a morpholino-ring.

Typical compounds according to the present invention are given hereinafter (see compounds I-1 to I-27), without however being limited thereto.

I-1

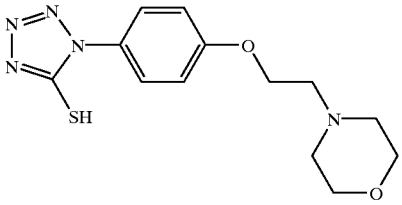

I-2

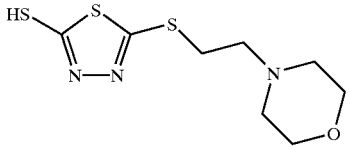

I-3

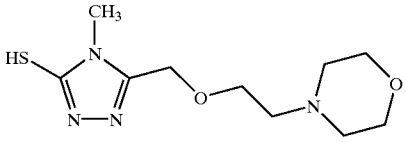

I-4

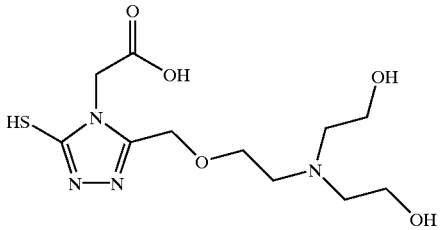

-continued
I-5
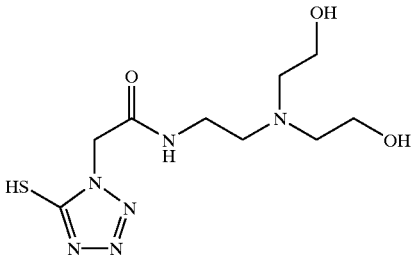
I-6
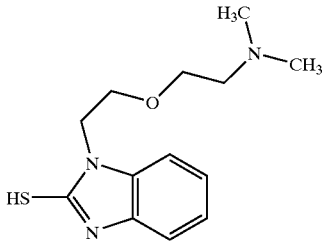
I-7
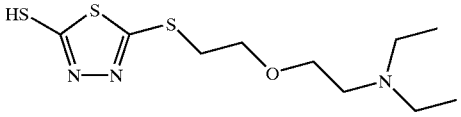
I-8
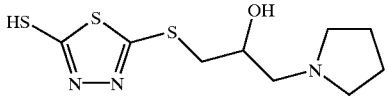
I-9
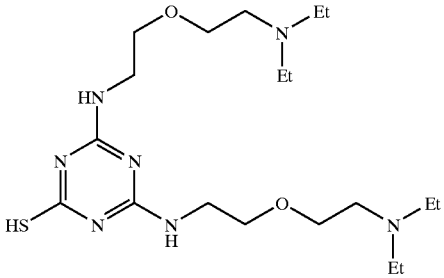
(I-10)
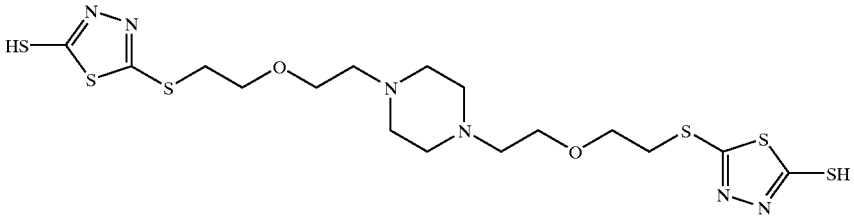
I-11
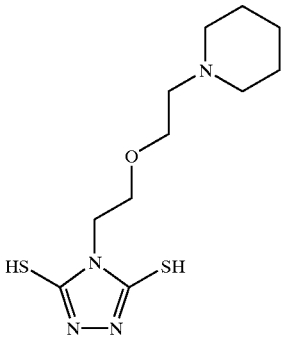
I-12
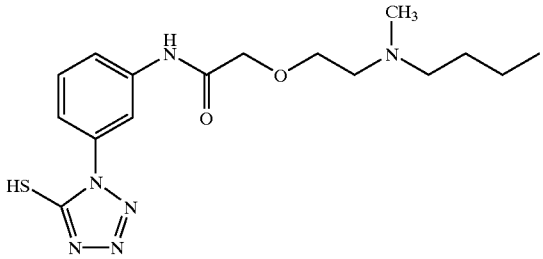
I-13
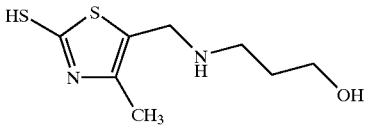
I-14
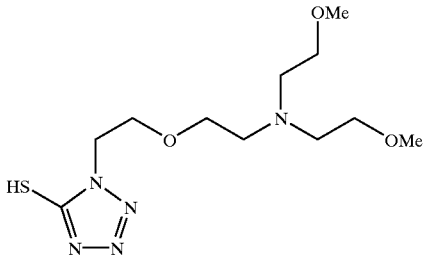

-continued
I-15
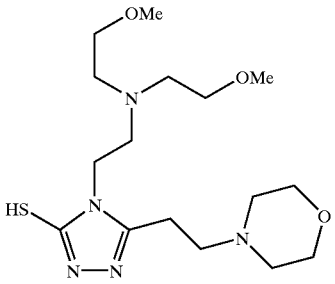
I-16
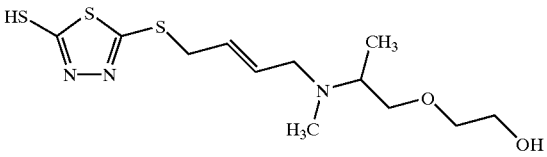
I-17
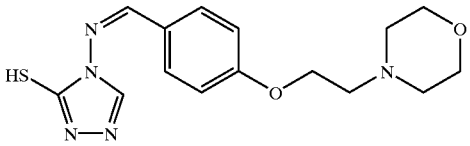
I-18
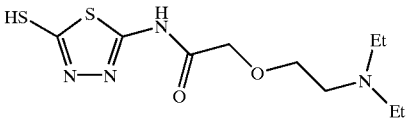
I-19
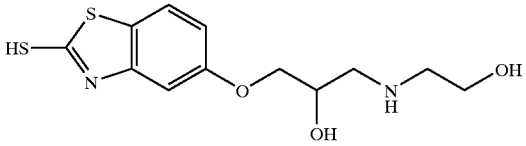
I-20
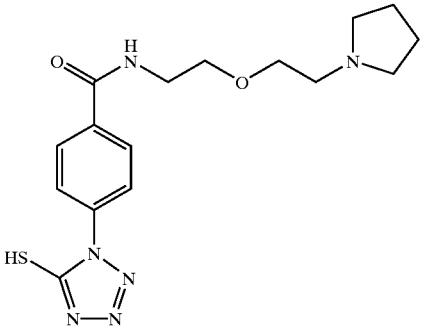
I-21
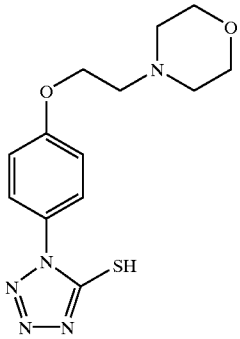
I-22
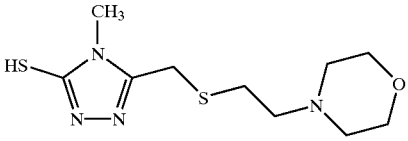
I-23
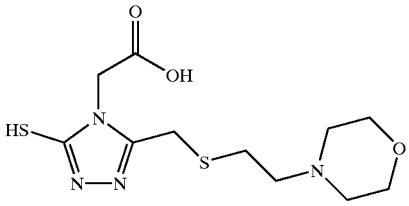
I-24
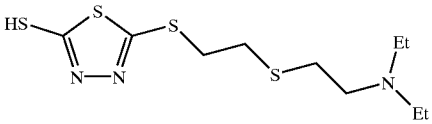

-continued

I-25

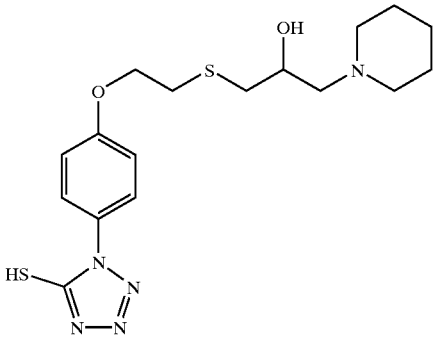

I-26

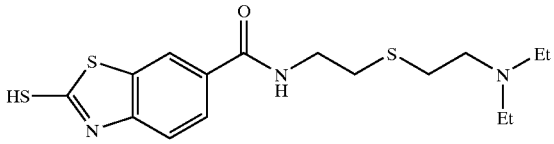

I-27

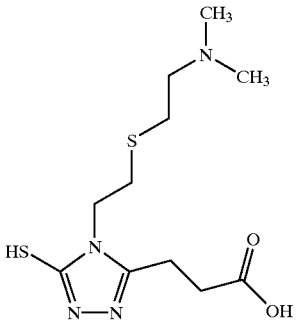

In a preferred embodiment according to the present invention said compound (or, in the alternative, at least one of those compounds) according to the general formula (I) is present in an amount of from 1 up to 5 mmole per mole of coated silver halide.

It is preferred, according to the present invention, to add to the protective antistress layer(s) of the material, besides the normally added components (see Examples), a compound according to the general formula (I), in exceptionally huge amounts of at least 0.5 mmole per mole of coated silver, more preferred from 1 mmole up to 5 mmole and even more preferred up to an amount of 10 mmole per mole of coated silver halide. It has been established that the presence, in an amount as prescribed, of at least one of such compounds in the non-light sensitive hydrophilic layers of the said material (as are the protective antistress layers, and, in the alternative, in the optionally present antihalation undercoats between subbing layer and light-sensitive emulsion layer, wherein both hydrophilic layers are coated adjacent to the light-sensitive silver halide emulsion layers) further improves image tone in that a "colder" blue-black image is obtained for at least the same and in an even increased covering power, besides remarkably better preservation characteristics.

In a preferred embodiment the said film material is a radiographic single-side coated or double-side coated (duplitized) material.

The protective antistress layers of the said radiographic material, according to the present invention, may be the outermost layers of the material but an outermost afterlayer may optionally be present as disclosed e.g. in EP-A's 0 644 454 and 0 644 456, wherein e.g. a synthetic clay is present in favour of pressure resistance.

Moreover protective antistress layers may be coated as two adjacent layers, wherein one or both can be provided with at least one compound according to the general formula (I). It is however understood that in a preferred embodiment said the layer coated adjacent to the emulsion layer should include such a compound.

Protective antistress layers, besides their function as protection layer may include compounds providing better antistatic properties as has been disclosed e.g. in EP-A 0 644 454 (with polyoxyalkylene compounds as antistatic agents), in EP-A's 0 505 626, 0 534 006 and 0 644 456. As said layers are in most cases outermost layers, their contribution to satisfactory surface characteristics of the processed film material is very important, e.g. from the point of view of an excellent surface glare as desired by examining medecins, as has been described in EP-A's 0 806 705 and 0 992 845.

When a antihalation undercoat is present, as described in e.g. U.S. Pat. Nos. 5,077,184 and 5,693,370 the said compound according to the formula (I) is advantageously present therein, particularly if the said compound would be absent in the protective antistress layers for whatever a reason and may be present therein if the said compound is present in the said protective antistress layers.

It has been established now that the presence of one or more compounds satisfying formula (I) in one or more non-light-sensitive layers (like the protective antistress layers and/or antihalation undercoat layers) adjacent to the light-sensitive silver halide emulsion layers of the (radiographic) material of the present invention further improves image tone in that a "colder" blue-black image is obtained as desired by medecins examining radiographs for at least the same, and even an increased covering power, besides good preservation characteristics before exposure.

The light-sensitive (photosensitive) layers of the film material of the present invention coated on one or each of the major surfaces of the subbed support, optionally provided with an antihalation undercoat, thus contain chemically and spectrally sensitized {111} tabular hexagonal silver halide emulsion grains or crystals rich in silver bromide in an amount covering at least 50%, more preferably at least 70% and most preferably at least 90% of the total projective surface of all grains, wherein the said tabular grains have a mean or average equivalent volume diameter of from 0.3 μm up to 1.0 μm and an average grain thickness of less than 0.30 μm, and more preferably from 0.05 μm up to 0.25 μm, wherein said film material is coated with a total amount of silver halide, expressed as an equivalent amount of silver nitrate of less than 7 g/m2, more preferably from 3.0 up to 6.0 g/m2.

In a preferred embodiment said grains are core-shell emulsion grains or crystals, present in an amount covering at least 50%, preferably at least 70% and most preferably at least 90% of the total projective surface of all grains, said grains being composed of a silver bromide core and a silver bromoiodide shell having an average amount over the whole crystal volume of more than 90 mole % of silver bromide, said grains further having a mean equivalent volume diameter of from 0.3 μm up to 1.0 μm and an average grain thickness of less than 0.30 μm, an amount of from 0.05 up to 0.5 mole %, based on silver, the said tabular grains having a mean or average equivalent volume diameter of from 0.3 μm up to 1.0 μm and an average grain thickness of less than 0.30 μm, wherein said film material is coated with a total amount of silver halide, expressed as an equivalent amount of silver nitrate of less than 7 g/m2, characterized in that said protective antistress layer, said antihalation undercoat or both said protective antistress layer and said antihalation undercoat comprise a heteroaromatic compound according to the general formula (I), given above, in an amount of at least 0.5 mmole, more preferably, from 1 mmole up to 10 mmole per mole of silver halide coated.

Average grain volumes can be determined from calculations, after measurement for each individual grain of its volume determined after having applied electrochemical reduction techniques, wherein electrical signals thus obtained are related with silver halide grain volumes after total reduction thereof to metallic silver at the cathode of an electrochemical cell. The percentage of the total projective area of all tabular grains with respect to the total projective area of all grains present in the emulsion is calculated from electron microscopic photographs (shadowed replicas). Average grain diameters and thicknesses of the tabular grains are calculated after determination of individual grain thickness and diameter, calculated as equivalent circular diameter of the hexagonal surface, from shadowed electron microscopic photographs or scanning electron microscopic photographs. From the average ratios of (equivalent circular) diameter to thickness for each individual tabular grain aspect ratios are determined in order to get ability to further calculate the mean aspect ratio of the tabular grains in the emulsion distribution.

The silver halide emulsions coated with at least one light-sensitive layer on at least one side of a transparent film support having first and second major surfaces coated on each of the said major surfaces of the support in at least one photosensitive layer, overcoated with a protective antistress layer, wherein said photosensitive layer is containing a tabular grain emulsion having tabular hexagonal core-shell emulsion grains or crystals in an amount covering at least 50% of the total projective grain surface of all grains, said grains being composed of a silver bromide core and a silver bromoiodide shell having an average amount over the whole crystal volume of more than 90 mole % of silver bromide, said grains having a mean or average equivalent volume diameter of from 0.3 μm up to 1.0 μm and an average grain thickness of less than 0.30 μm, more preferably from 0.05 μm up to 0.25 μm, and even more preferably from 0.05 μm up to 0.15 μm and wherein said film material is coated with a total amount of silver halide, expressed as an equivalent amount of silver nitrate of less than 7 g/m2, more preferably from 3.0 up to 6.6 g/m2. Typical for a core-shell structure as present in the tabular hexagonal grains of the present invention is that at least two regions having a differing silver halide composition are present in the grain volume: the inner core is composed of silver bromide, thus free of iodide, while the outermost shell corresponding with at most 20% of all silver halide precipitated has a silver bromoiodide composition, thus having silver iodide in an amount in order to get a (low) average amount in the range as set forth hereinbefore, i.a., from 0.05 up to 0.5 mole % of iodide, based on silver, over the whole crystal volume of the tabular hexagonal grains in the material of the present invention.

In a more preferred embodiment said tabular grains have all silver iodide present on the grain surface thereof, in an amount in order to get said average amount of silver iodide over the whole grain volume of from 0.05 mole % up to 0.5 mole %.

Not only in favour of image tone as set forth in the objects of the present invention but also in favour of developability (rapid material processing) it is an essential feature to have an amount of iodide in the outermost shell of the tabular grains, and even more preferred, at the grain surface of the tabular grains in order to get an average amount of iodide over the whole grain volume in the range set forth hereinbefore.

The (radiographic) film material according to the present invention thus comprises light-sensitive layers at one or both sides of the film support wherein {111} tabular silver halide grains rich in silver bromide (having at least 90 mole % of silver bromide, based on silver) and containing silver iodide in the limited amounts as set forth hereinbefore in the outermost shell representing at most 20% of all silver halide precipitated, and more preferred at the grain surface. Said tabular grains have an average aspect ratio of 5 or more, preferably in the range from 5 to 20, an average grain thickness of less than 0.30 μm, more preferably less than 0.25 μm, and even more preferably in the range from 0.05 μm up to 0.15 μm and account for at least 50% (more preferably at least 70% and even most preferably at least 90%) of the total projective area of all grains. More preferably said tabular grains having an average aspect ratio of from 5 up to 20 and have an average grain thickness of from 0.05 μm up to 0.15 μm, and contribute to the total projective area of all grains as set forth hereinbefore. In a further preferred embodiment the {111} tabular hexagonal grain population making part of a light-sensitive emulsion is homogeneous, i.e., has a variation coeffient of less and 0.40 and more preferably even from 0.10 up to 0.30, based on the equivalent circular diameters calculated for the individual {111} tabular grains.

Preparation methods for {111} tabular grain emulsions rich in silver bromide suitable for use with respect to tabular grains in materials of the present invention can be found in Research Dislosure No. 389057, p. 591–639 (1996), more particularly in Chapter I. A very useful method has e.g. been described in EP-A 0 843 208. Said {111} tabular hexagonal crystals rich in silver bromide are thus composed of silver bromoiodide or silver bromochloroiodide (with less than 10 mole % of silver chloride, based on silver). In a more preferred embodiment according to the present invention said grains are silver bromoiodide grains. Iodide ions added during precipitation of the last amount of at most 20% of all precipitated silver halide or, in an even more preferred embodiment, at the surface of al {111} tabular hexagonal grains, are provided in the preparation method by addition of an inorganic iodide salt as potassium iodide, thus causing conversion. More preferred as providing slower liberation of iodide in the reaction vessel is addition of organic agents releasing iodide ions in order to provide the low silver iodide concentrations, not exceeding 1 mole % and even more preferably not exceeding the range from 0.1 mole % up to 0.4 mole % based on silver and calculated as an average value over het whole grain volume. Addition of iodide by organic agents releasing iodide ions has been described e.g. in EP-A's 0 561 415, 0 563 701, 0 563 708 and 0 651 284 and in U.S. Pat. Nos. 5,482,826 and 5,736,312. In an alternative method iodide ions can be released from iodate as has been described in U.S. Pat. No. 5,736,312. Release of iodide in the presence of a compound adjusting the rate of iodide release can be applied as described in U.S. Pat. No. 5,807,663.

In another preferred embodiment addition of iodide to emulsion grains rich in silver bromide (having a preferred silver bromoiodide composition) is performed by adding fine preformed grains of silver iodide, whether or not including bromide (and/or, optionally, chloride in minor amounts), said grains having a grain diameter of not more than 100 nm, and more preferably, not more than 50 nm. Such fine grains are so-called "Lippmann" emulsions. Addition of iodide making use from such fine grains rich in silver iodide (or even pure silver iodide) has been described for the preparation of {111} tabular grains in JP-A's 04-251241 and 08-029904 and in EP-A's 0 662 632 and 0 658 805, wherein an outermost phase rich in silver iodide has been added to {111} tabular grains rich in silver bromide (optionally comprising up to less than 10 mole % of silver chloride). Addition of fine AgI-Lippmann emulsions to the surface of the silver halide crystals in order to get a global iodide content in the range from 0.05 up to 0.5 mole % over the whole grain volume may advantageously proceed as disclosed in EP-A 0 475 191, wherein an excellent speed/fog ratio and a high covering power are attained.

The material according to the present invention invention thus has silver halide grains, composed of silver bromoiodide.

Preparation of the {111} tabular grain emulsions is performed in the presence of gelatin or colloidal silica sol as a binder providing colloidal stability during all preparation steps.

In one embodiment the precipitation of the tabular silver halide crystals according to the present invention is performed in the presence of a protective, hydrophilic colloid, e.g. conventional lime-treated or acid treated gelatin but also oxidized gelatin (see e.g. EP-A 0 843 208) or a synthetic peptiser may be used. The preparation of such modified gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium.

In another embodiment tabular silver halide grains used in emulsions according to the present invention are precipitated in the absence of gelatin by using colloidal silica sol as a protective colloid in the presence of an onium compound, preferably a phosphonium compound, as has been described in EP-A 0 677 773.

In order to control the grain size, beside dyes (even spectral sensitizing dyes e.g.) or crystal habit modifiers, other grain growth restrainers or accelerators may also be used during the precipitation, together with the flow rate and/or concentration variations of the silver and halide salt solutions, the temperature, pAg, physical ripening time, etc. Silver halide solvents such as ammonia, a thioether compound, thiazolidine-2-thione, tetra-substituted thiourea, potassium or ammonium rhodamide and an amine compound may be present during grain precipitation in order to further adjust the average grain size.

At the end of the precipitation the emulsion is made free from excess of soluble inorganic salts by a conventional washing technique e.g. flocculation by ammonium sulphate or polystyrene sulphonate, followed by one or more washing and redispersion steps. Another well-known washing technique is ultrafiltration or diafiltration. Finally, extra gelatin is added to the emulsion in order to obtain a gelatin to silver ratio which is optimized with respect to the coating conditions and/or in order to establish the required thickness of the coated emulsion layer. Preferably a gelatin to silver halide weight ratio ranging from 0.3 to 1.0 is then obtained.

It is clear that {111} tabular silver halide emulsion grains, present in light-sensitive emulsion layers of materials according to the present invention, are, besides spectrally sensitized, also chemically sensitized, at least with a combination of labile sulphur compounds and gold compounds, more preferably with compounds providing sulphur, selenium (without even excluding tellurium) and gold. Chemical sensitization methods for {111} tabular grain emulsions rich in silver bromide can be found in Research Dislosure No. 389057, p. 591–639 (1996), more particularly in Chapter IV. Very useful methods related therewith have been disclosed in EP-A's 0 443 453, 0 454 069, 0 541 104 and in U.S. Pat. Nos. 5,112,733 and 5,654,134. Useful labile selenium compounds have been disclosed in EP-A's 0 831 363, 0 889 354 and 0 895 121. Said labile selenium compounds are commonly applied in combination with sulphur and gold, and so are labile tellurium compounds as has been disclosed e.g. in EP-A 1 070 986.

The {111} tabular silver halide emulsion grains, present in light-sensitive emulsion layers of materials according to the present invention, are spectrally sensitized in the blue to near ultraviolet wavelength range and/or green wavelength range, depending on the requirements as set forth by medecins examining radiological images as especially sharpness (low cross-over percentage), but also contrast (which should be a "dedicated contrast" depending on the density range wherein image details should be discernable), speed and density range.

Preparation of spectrally and chemically sensitized tabular grains as may be applied to emulsion grains to be coated light-sensitive layers of a radiographic material according to the present invention has been described in U.S. Pat. No. 4,439,520, wherein it has been established to perform spectral sensitization before chemical sensitization, so that the spectral sensitizer acts as a site-director for the sensitivity specks, generated during chemical sensitization. A broad review about spectral sensitization can be found in in Research Dislosure No. 389057, p. 591–639 (1996), more particularly in Chapter V. Further useful information about additives which may be used in order to prepare emulsions to be coated in a material according to the present invention can be found in Research Disclosure No. 389057, p. 591–639 (1996), as in Chapter VII about antifoggants and stabilizers, in Chapter VIII about coating physical property modifying addenda, in Chapter XI about layer arrangements and in Chapter XV about supports.

In one embodiment according to the present invention the duplitized film material comprises light-sensitive emulsion layers coated on both sides of a subbed support (i.a. a support coated with good adhesion providing subbing layers) with, optionally, inbetween said subbing layers and the light-sensitive layers coated thereupon, a hydrophilic non-light-sensitive layer, e.g. comprising antihalation dyes providing less cross-over and thus a better sharpness as described e.g. in U.S. Pat. Nos. 5,344,749; 5,478,708; 5,811,545 and 5,811,546. Said light-sensitive layers present in the material according to the present invention further comprise, in one embodiment, an emulsion having {111} hexagonal tabular grains rich in silver bromide, spectrally sensitive to irradiation in the wavelength range shorter than 420 nm by the presence of at least one J-aggregating zeromethine blue spectral sensitizer (preferred sensitizers have been given in EP-A's 0 712 034 and 1 045 282). Moreover at least one dye selected from the group consisting of azacyanine dyes and monomethine cyanine dyes, as further disclosed in the already cited EP-A 1 045 282 is preferably present. So the material according to the present invention has grains which have thus been made sensitive to the ultraviolet and/or blue range of the wavelength spectrum, wherein the blue/ultraviolet absorbing dye combination of zeromethine dyes with monomethine or azacyanine sensitizing dyes absorbing blue/UV-radiation as described in EP-A 1 045 282 is particularly preferred and suitable for use when the radiographic material according to the present invention is applied in combination with a blue/UV-intensifying screen. Besides the favourable diagnostic value with respect to image quality thanks to a low fog level, a high overall contrast, an enhanced sharpness (low cross-over percentage) and absence of residual colour, even in rapid processing cycles, as described therein, a particularly good image tone is provided offering cold black-bluish images as desired by the examiners, according to the objects of the present invention.

Said blue-sensitizing dye or dyes are added as first dye during the chemical ripening procedure, before addition of the chemical ripening compounds or agents. Mixtures of blue sensitizing dyes are particularly interesting from the point of view of an increased spectral response in form of speed, which can be achieved at lower total amounts of dyes as becomes clear from U.S. Pat. No. 5,707,794.

In another embodiment the material according to the present invention has grains which have been made sensitive to the green range of the wavelength spectrum, more particularly in the wavelength range from 530 to 580 nm, and even more preferred in the range from 540 up to 570 nm. The film material, advantageously used as radiographic material, thus has at least one emulsion comprising hexagonal {111} tabular silver halide grains rich in silver bromide (silver bromoiodide, optionally containing chloride in amounts of less than 10 mole % based on silver), spectrally sensitive to irradiation in the green wavelength range by the presence of at least one J-aggregating spectrally sensitizing tri-methine cyanine dye according to the general formula given in EP-A 0 678 772 and 0 953 867, wherein e.g. trimethine benzoxazoles and imidazoles are used apart or in combination, and of at least one dye selected from the group consisting of monomethine cyanine dyes and azacyanine dyes mentioned hereinfore.

Therefore in a preferred embodiment radiation-sensitive emulsions having silver bromoiodide grains, as in the present invention, sensitive to irradiation in the wavelength range between 530 and 580 nm, are made sensitive thereto by the presence of a J-aggregating spectrally sensitizing cyanine dye as the particularly preferred J-aggregating orthochromatic oxacarbocyanine dyes anhydro-5,5'-dichloro-3,3'-bis(n-sulpho-butyl)-9-ethyloxacarbocyanine hydroxide and anhydro-5,5'-dichloro-3,3'-bis(n-sulphopropyl)-9-ethyloxa-carbocyanine hydroxide. Furthermore green-light absorbing spectral sensitizers according to the formulae given in JP-A's 06,035,104; 06,035,101; 06,035,102; 62,191,847; 63,249,839; 01,312,536; 03,200,246; U.S. Pat. No. 4,777,125 and DE 3,819,241 may be used. The right choice of said sensitizers or combinations thereof is always related with the purpose of obtaining the highest possible photographic speed while reducing possible dye stain, due to the use of huge amounts of dyes after processing, especially in rapid processing cycles.

As it is a particularly favourable aspect for materials coated from emulsions having tabular grains in general, and more specifically for materials according to the present invention coated from emulsions having tabular hexagonal {111} tabular grains to be coated with lower amounts of silver without loss of covering power in the material, the total amount of silver halide coated in said film material, expressed as an equivalent amount of silver nitrate, is less than 7.0 g/m2, preferably in the range from 3.0 to 6.6 g/m2.

Duplitized film materials (defined as materials having radiation-sensitive emulsions layers, coated at both sides of the material support), particularly suitable for use in radiographic applications, are irradiated by the light emitted imagewise by X-ray intensifying screens after conversion of X-ray radiation to the said light by luminescent phosphors coated in the said screens or panels, in intimate contact therewith at both sides of the coated film support during X-ray exposure of part of a patient. A diagnostic silver image, in conformity with the X-ray image, is obtained after processing of the said film material. For use in common medical radiography (projection radiography) the X-ray film material comprises a transparent film support, coated on both sides with at least one silver halide emulsion layer, further overcoated with at least one protective antistress layer and, optionally, an afterlayer as disclosed e.g. in EP-A's 0 644 454 and 0 644 456. It is further preferable to add to the protective antistress layer(s), besides the normally added components, a heteroaromatic azole compound, preferably having on a five- or six-membered heteroaromatic azole ring, as a substituent an amino-ether or amino-alcohol, wherein said substituent is not part of an azacrown ether. Huge amounts of said compound(s) of at least 0.5 mmole per mole of coated silver, more preferably 1 mmole and even up to an amount 10 mmole are present. It has been established that presence of such compounds in the protective antistress layer(s) further improves image tone in that a "colder" blue-black image is obtained for at least the same and even an increased covering power, with the remark that use of tetrazoles in the protective antistress layer is more effective when lower amounts of silver iodide are present at the grain surface of the {111} tabular grains.

During the X-ray irradiation said film is arranged in a cassette between two X-ray intensifying screens each of them making contact with its corresponding light-sensitive side, thus forming a film/screen system or said film is in contact with one single X-ray intensifying screen in case of a single-side coated radiographic material.

According to the present invention a radiographic screen/film combination or system is thus provided, said system comprising a radiographic film material as disclosed in the present invention in contact with one supported or self-supporting X-ray intensifying screen or sandwiched between a pair of said screens, wherein said intensifying screen or screens comprise(s) luminescent phosphor particles emitting at least 50% of their emitted radiation in the wavelength range for which said material has been made spectrally sensitive.

In one embodiment according to the present invention a radiographic screen/film combination or system has been provided comprising a duplitized film material, sandwiched between a pair of supported or self-supporting X-ray intensifying screens, characterized in that i) said pair of supported or self-supporting X-ray intensifying screens essentially consists of luminescent phosphor particles emitting at least 50% and more preferably at least 80% of their emitted radiation in the wavelength range shorter than 420 nm, as e.g. a niobium and gadolinium doped, monoclinic M, yttriumtantalate (MYT) phosphor or a calcium tungstate phosphor;

ii) said film comprises {111} tabular silver halide grains rich in silver bromide, spectrally sensitive to irradiation in the said wavelength range shorter than 420 nm by the presence of at least one J-aggregating blue spectral sensitizer (e.g. a zeromethine sensitizer as disclosed in EP-A 0 712 034) and of at least one of the non-J-aggregate forming dyes selected from the group consisting of azacyanine dyes and monomethine cyanine dyes (as disclosed in EP-A 1 045 282) respectively, mentioned hereinbefore in the description, wherein said emulsion is present in at least one light-sensitive emulsion layer on at least one side of the film support of the radiographic material of the present invention.

As the radiographic film material as claimed has as least one silver bromoiodide emulsion comprising {111} tabular grains, spectrally sensitive to irradiation in the wavelength range shorter than 420 nm by the presence of at least one spectrally sensitizing zeromethine dye and of at least one dye selected from the group consisting of monomethine cyanine dyes and azacyanine dyes respectively, the film perfectly matches with the screen emitting said radiation in the wavelength range shorter than 420 nm as in a preferred embodiment of the present invention absorption of radiation in the said wavelength range shorter than 420 nm by the {111} tabular silver bromoiodide grains is corresponding with at least 50% and more preferably at least 80% of the total radiation absorption by the said grains.

Luminescent phosphors suitable for use in a conventional intensifying screen of a radiographic film/screen system as the one according to the present invention must have a high prompt emission of fluorescent light on X-ray irradiation and low afterglow in favour of image sharpness. The relationship between resolution and speed of X-ray intensifying screens is described e.g. in Med. Phys. 5(3), 205 (1978). Specific intensifying screens emitting ultraviolet-blue radiation have e.g. been disclosed in U.S. Pat. Nos. 4,225,653; 4,387,141; 4,710,637; 5,112,700; 5,173,611 and 5,432,351; in EP-A's 0 650 089; 0 658 613; in PCT-Applications WO 93/11457 and WO 95/15514. Typical blue-UV emitting phosphors therein are tantalates as described in PCT-Applications WO 93/1521 and 93/1522, hafnates as described in U.S. Pat. No. 5,173,611 and fluorohalides (fluorobromides) of barium and strontium as in WO 91/1357 and U.S. Pat. No. 5,629,125, doped with europium and co-doped with samarium as in U.S. Pat. Nos. 5,422,220 and 5,547,807 and even mixtures of tantalates and fluorohalides as in U.S. Pat. No. 5,077,145 and EP-A 0 533 234, replacing CaWO4 as representative for an older well-known generation of luminescent phosphors. Very useful phosphor particles have e.g. been disclosed in EP-A 0 820 069 wherein particles of niobium doped, monoclinic M, yttriumtantalate phosphor and particles of an europium doped bariumfluorohalide phosphor are composing the screen.

In the film/screen system according to the present invention preferred phosphor particles are niobium and gadolinium doped, monoclinic M, yttriumtantalate (MYT) phosphor corresponding to formula (III):

$$YTaO_4:Gd:Nb \quad \text{(III)}$$

In another embodiment the radiographic film material has {111} tabular silver bromoiodide emulsions spectrally sensitized with spectrally sensitizing dyes absorbing light in the green wavelength range.

In another embodiment according to the present invention a radiographic screen/film combination or system is thus provided comprising a duplitized film material, sandwiched between a pair of supported or self-supporting X-ray intensifying screens, characterized in that i) said pair of supported or self-supporting X-ray intensifying screens essentially consists of luminescent phosphor particles emitting at least 50% and more preferably at least 80% of their emitted radiation in the green wavelength range from 500 nm to 550 nm, as e.g. a terbium doped gadolinium oxisulfide phosphor;

ii) said film comprises {111} tabular silver halide grains rich in silver bromide, spectrally sensitive to irradiation in the said wavelength range from 500 to 550 nm by the presence of at least one J-aggregating green spectral sensitizer and of at least one the non-J-agregating dyes selected from the group consisting of azacyanine dyes and monomethine cyanine dyes, as mentioned hereinbefore respectively, wherein said emulsion is present in at least one light-sensitive emulsion layer on at least one side of the film support.

In the context of the present invention, more particularly with respect to the purposes to get reduced dye stain besides an excellent image tone, said reduced dye stain delivering an indispensible asset thereto, azacyanine dyes are advantageously used in the preparation of {111} tabular grain emulsions as the presence of said dyes permits further addition of J-aggregating spectral sensitizers in lower amounts, without loss in speed, thereby providing better decolouration in the processing. A survey of other useful chemical classes of J-aggregating spectral sensitizers suitable for use in spectrally sensitizing emulsions of the present invention has been described by F. M. Hamer in "The Cyanine Dyes and Related Compounds", 1964, John Wiley & Sons and other examples specifically useful for spectral sensitization of tabular grains have been given in Research Disclosure Item 22534 and in addition a more recent overview has been given in EP-A 0 757 285, wherefrom dyes forming J-aggregates on the flat surface of the preferred silver bromide or silver bromoiodide crystals are particularly useful. It is moreover preferred that the radiation-sensitive emulsion used in the material according to the present invention has one or more azacyanine dye(s) and (a) J-aggregating spectrally sensitizing dye(s), whether providing spectral sensitivity in the blue/UV or in the green light range in a ratio amount of more than 1:4 for a grain coverage exceeding 50%.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are, i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/for-maldehyde condensation products as described e.g. in U.S. Pat. No. 3,743,510 as well as cadmium salts and azaindene compounds.

At least one non-spectrally sensitizing dye can be added to an emulsion layer or to one or more non-light-sensitive hydrophilic layers such as an optionally present antihalation undercoat between the subbing layer and the emulsion layer as has e.g. been described in U.S. Pat. Nos. 5,077,184 and 5,693,370. The presence of such dye(s) in adapted amounts in an emulsion layer can even be recommended in order e.g. to adjust the sensitivity of the emulsion layer(s) or the required contrast, but also in order to reduce scattering of exposure radiation and thus to enhance sharpness. Preferred dyes are those that are removed easily from the photographic material during wet processing in order not to leave any residual colour. When said dyes are added to the emulsion side, it may be preferred that these dyes are non-diffusible during coating of the hydrophilic layers. Examples of such dyes, without being limited thereto, are the dyes that have been described in e.g. U.S. Pat. Nos. 3,560,214; 3,647,460; 4,288,534; 4,311,787 and 4,857,446. These dyes may be added to the coating solution as a solid particle dispersion of water insoluble dyes having a mean particle diameter of less than 10 $\mu$m, more preferably less than 1 $\mu$m and still more preferably less than 0.1 $\mu$m. Examples of such dyes are disclosed in EP-A's. 0 384 633; 0 351 593; 0 586 748; 0 587 230 and 0 656 401, EP-A's. 0 323 729; 0 274 723 and 0 276 566, and in U.S. Pat. Nos. 4,900,653; 4,904,565; 4,949,654; 4,940,654; 4,948,717; 4,988,611; 4,803,150 and 5,344,749. Said dyes can also be added in form of a solid silica particle dispersion as disclosed in EP-A 0 569 074. Still another technique applied in order to obtain ultra fine dye dispersions consists in acidifying a slightly alkaline coating composition "in situ" just before coating it onto the supporting layer. A more recent review of dispersion methods, useful in the context of the present application has been described in EP-A 0 756 201.

The silver halide emulsions used in light-sensitive layers of the material according to the present invention may also comprise compounds preventing the formation of a high minimum density or stabilizing the photographic properties during the production or storage of photographic materials or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethio-sulphinic acid and benzenethiosulphonic acid amide.

Other compounds which can be used as fog-inhibiting compounds are those described in Research Disclosure No. 17643 (1978), Chaptre VI. These fog-inhibiting agents or stabilizers can be added to the silver halide emulsion prior to, during, or after the ripening thereof and mixtures of two or more of these compounds can be used.

The binder of the layers, especially when gelatin is used as a binder, can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitization and development acceleration. Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos. 3,038,805; 4,038,075 and 4,292,400. Especially preferred developing accelerators are recurrent thioether groups containing polyoxyethylenes as described in DE 2,360,878, EP-A's 0 634 688 and 0 674 215. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material of the present invention may further comprise various other additives such as compounds improving the dimensional stability of the photographic material, UV-absorbers, spacing agents, lubricants, plasticizers, antistatic agents, etc. Suitable additives for improving the dimensional stability are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids. Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds As described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material according to the present invention may comprise an antistatic layer to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides (see e.g. EP-A 0 890 874) or a polymer latex and the like or polymers providing permanent antistatic properties as polyethylene dioxythiophenes (PEDT). described e.g. in U.S. Pat. Nos. 5,312,681; 5,354,613 and 5,391,472; and in EP-A 1 031 875.

Figure 2:
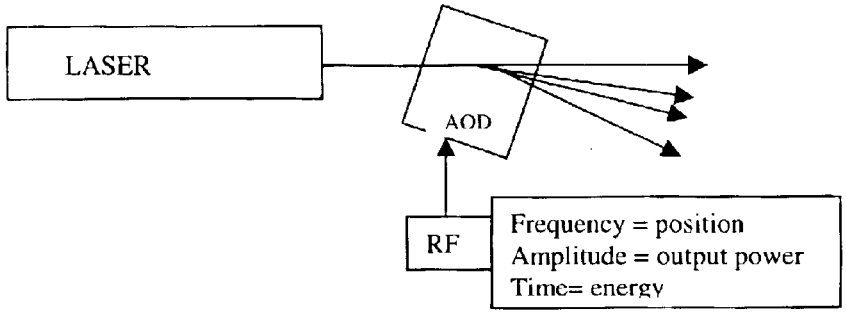
FIG. 2 shows a laser in continuous mode in combination with an AOD (Acousto Optic Deflector).

The photographic material according to the present invention further comprises an indication that has been applied by laser marking and that becomes visible after processing. Laser marking of the photosensitive material is very critical as during the marking (burning, ablation) process, characterised by ablation and combustion phenomena, light may be emitted, thus causing fog spots on the material. Even with "invisible" laser wavelengths in the far infrared region (e.g. with $CO_2$-lasers, wave-lengths in-between 9 and 11 μm) which do not affect, expose the photosensitive material directly, the marking process may result in visual light emissions and exposure of the photosensitive material. Such light flashes may thus cause unacceptable big black fog spots on the material. In order to avoid fog spots and to prevent these damaging side effects it is a key issue to keep the laser energy density on the product stable and as low as possible as during marking a plasma or dust cloud is generated, which may cause secondary light flashes in form of small "fires", due to combustion of plasma and dust near the laser-impinging surface. In order to avoid this it is important to remove the plasma and dust in a fast and efficient way. The higher the marking and product speed, the higher the plasma and/or dust concentration will be and the higher the risk of light flashes. A better extraction of the said plasma and dust is highly desired. In order to avoid fog spots, caused by burning of plasma and dust particles, it is important to remove the plasma and dust as quick as possible and to get it away from the laser beam during marking. It is recommended not to create a "chamber" near or around the laser head because of the risk of getting high plasma and/or dust concentrations near the laser beam so that locally big light flashes or explosions may be caused. The best solution therefor is provided by creating a tunnel with an open entry and an exit, which is led to a strong extraction unit. It is highly preferred to have the product flow directed from the entry side to the exit side, thereby generating an airflow in the direction of the extraction exit of the tunnel as otherwise the cloud will become pulled back under the laser beam, thus resulting in a higher risk of secondary combustions and light emissions, that are responsible for fog on the laser marked film in that case. As a higher production speed requires a higher marking speed, a higher the plasma concentration will locally be present if the plasma cloud is not removed. Otherwise a higher production speed is in favour of generation of a faster moving air flow caused by the product flow itself. The efficiency is moreover enhanced by directing an air jet, skimming on the laser-impinging surface, from the entrance of the tunnel in the direction of the product flow. Moreover in order to mark critical layers and products and to get controll of the marking process, and more particularly, of penetration depth, it is important to keep the energy density on the product stable. As a starting point presence of dust or dirt on the product should be thus be avoided as much as possible. Moreover dust and plasma particles are generated by the marking process itself and as these are highly flammable and may cause light emissions and fog spots on the material, it is of utmost importance to keep the product clean in order to prevent repeating marks on the same spot. Following concepts have been proved in order to prevent these damaging side effects. In order to mark the material on different positions, in order to build alphanumeric characters, to create logos and drawings, different techniques are used in order to keep the energy stable, thereby preventing damaging of the laser marked material by light flashes. Illustrated in FIG. 2 is a laser in continuous mode in combination with an acousto optic deflector or AOD, in order to mark the material on different positions. In this concept the laser itself is working in a continuous mode at a fixed power level. The beam is deflected by a high frequency signal and it is a property of the AOD (Acousto Optic Deflector) crystal that the efficiency is not equal all over the crystal and deflection positions. For every frequency used or for every deflection position the energy density on the product can be tuned in two ways. Tuning the amplitude for each frequency deflection position will result in a more equal energy density on the product. By adjusting the time a frequency is gated to the AOD crystal (dwell time): independently for each frequency deflection position the energy density on the product will be tuned. Laser and AOD must be cooled efficiently and held stable, because temperature shocks and drifts will result in energy density changes.

Figure 3:
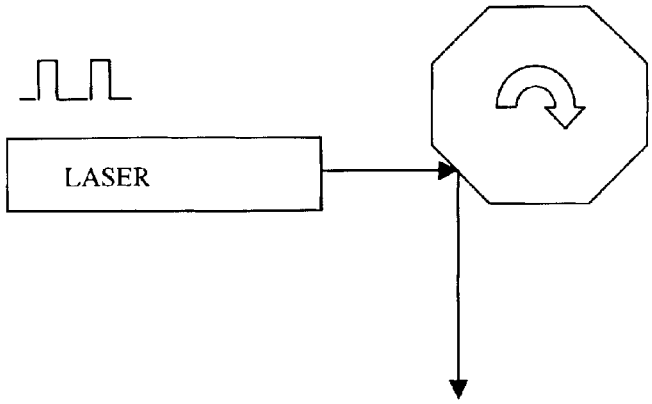
FIG. 3 shows a pulsed laser in combination with moving deflecting mirrors, wherein the laser itself is electronically pulsed.

In FIG. 3 a pulsed laser in combination with moving deflecting mirrors has been shown: in this concept the laser itself is electronically pulsed. The laser beam is deflected by a rotating polygon or by a galvo-oscillating mirror and in this concept the laser pulses used are often very short and the energy packages included in those pulses are not easy to controll and are difficult to be kept stable. Also the marking process on the product is not easy to controll with short intense laser energy pulses. It is better to use longer, less intense laser energy pulses which will give a smoother and better controllable marking effect. By putting the laser out of focus or putting an attenuator or diaphragm in the laser beam path, problems in beam homogenity (hot spots), peak intensity in the spot, will be smoothed and longer laser pulse time will be required in order to get the same energy density on the product. For the longer laser pulse times the energy packages will be more stable.

Figure 4:
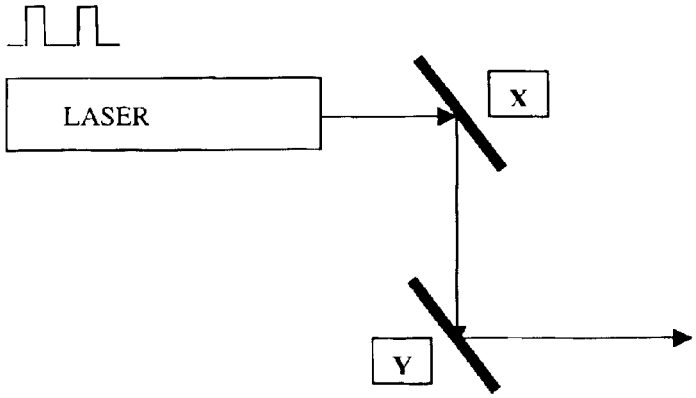
FIG. 4 shows vector lasers (in order to control the laser energy density, and peak intensity on the product), making use of a pulsed laser as shown in FIG. 3, and of two galvano mirrors providing ability to write continuously in two dimensions.

FIG. 4 is illustrative for vector lasers: such lasers make use of a pulsed laser as described in the concept with respect to pulsed laser in combination with moving deflecting mirrors hereinbefore. The same technique as described therein is used in order to control the laser energy density, and peak intensity on the product (the film material of the present invention) to be marked. With the vector laser two galvano mirrors are used, providing ability to write continuously in two dimensions. In this concept the risk exists that certain mark spots are hit twice (so-called "cross points") which will cause fog spots or stronger burn inns. In order to prevent this a special font, driver software will be used to prevent the said "cross points".

Figure 5:
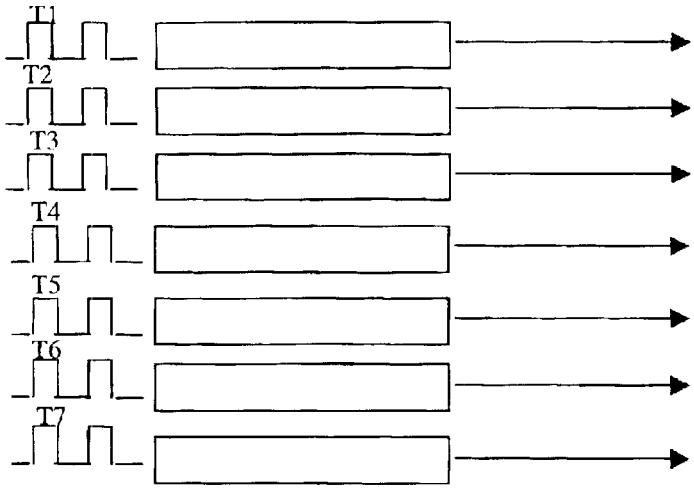
FIG. 5 shows multiple laser system for high speed marking applications in dot matrix systems.

In FIG. 5 a multiple laser system, particularly suitable for use in high speed marking applications, is used in dot matrix systems. In this concept the lasers are electronically pulsed. Also in these concepts the laser pulses used are often very short so that the energy packages included in those pulses are not easy to controll and difficult to keep stable. By putting the laser out of focus, problems in beam homogenity (hot spots), peak intensity in the spot, will be smoothed. Longer laser pulse time will be required in order to get the same energy density on the product. For the longer laser pulse times the energy packages will be more stable. Because of differences in-between the different lasers the pulse width of the different lasers will be controlled independently. Also degradations in the lasers which result in unequal marking quality can be compensated. Lifetime and maintenance cost will clearly be reduced thereby.

During X-ray irradiation of the radiographic film material of the present invention said film material (made sensitive to green or blue light by suitable spectral sensitization of its light-sensitive emulsion grains) is arranged in a cassette with one X-ray intensifying screen (emitting green or blue light by suitable luminescent phosphors) making contact with the silver halide emulsion layer. For chest radiography said cassette is provided with two X-ray intensifying screens making contact with two X-ray intensifying screens, being the same or different. When two intensifying screens are used it is thus possible to use two identical screens (having same radiation sensitivity), to use two screens emitting the same irradiation but differing in speed, e.g. due to different coating amounts of phosphors (coating thickness), or even to use two intensifying screens having a different light emission. So combination of an intensifying screen sensitive to blue/UV-irradiation and a screen sensitive to green light may be favourable in order to attain desired properties with respect to sensitometry (desired sensitometric curve from the point of diagnostic view) and/or image quality (granularity and/or image definition, particularly sharpness).

Specific intensifying screens or conversion screens emitting green or blue light for use in the diagnostic image forming method according to the present invention are the commercially available X-ray generating devices providing an exposure to X-rays (e.g. with a tube voltage from 70 kV up to 100 kV—as in chest radiography—without however being limitative).

A preferred luminescent phosphor coated in the X-ray conversion screen used in a film/screen system sensitive to (visible) green light is $Gd_2O_2S$:Tb, emitting light in the wavelength range from 540 to 555 nm. Said phosphor and its use in intensifying screens have been described extensively in patent literature, e.g. in U.S. Pat. Nos. 3,872,309; 4,130,429; 4,912,333; 4,925,594; 4,994,355; 5,021,327; 5,107,125 and 5,259,016 and in GB-Patent 1,489,398 and is suitable for use in the context of the film/screen system according to the present invention. The thickness of the phosphor layer therein depends on the amount of coated phosphor required in order to obtain the desired screen speed. X-ray intensifying screens used in the film/screen system according to the present invention can be self-supporting or supported. X-ray intensifying screens in the screen/film system according to the present invention generally comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto.

X-ray intensifying screens according the present invention can be self-supporting or supported. X-ray intensifying screens in accordance with the present invention generally comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto. A plastic film is preferably employed as the support material. Depending on the speed class of the screens for which a synergistic effect should be attained in the relation between speed and sharpness, supports characterized by their reflectance properties, expressed as % reflectance over the wavelength range from 350 to 600 nm, are particularly used as described e.g. in U.S. Pat. No. 5,381,015. Such supports can be highly light reflecting as e.g. polyethylene terephthalate comprising a white pigment, e.g. BaSO4, TiO2, etc., or it can be light absorbing supports, e.g. polyethylene terephthalate comprising a black pigment, e.g. carbon black. Supports comprising dyes or pigments that absorb light of a specific wavelength can also be useful in the preparation of X-ray intensifying screens in the film/screen system according to the present invention. In most applications the phosphor layers contain sufficient binder to give structural coherence to the layer. A mixture of two or more of these binders may be used, e.g., a mixture of polyethyl acrylate and cellulose acetobutyrate. The weight ratio of phosphor to binder is generally within the range of from 50:50 to 89:11, preferably from 80:20 to 89:11. The screen used in a screen/film system according to the present invention may comprise a supported layer of phosphor particles dispersed in a binding medium comprising one or more rubbery and/or elastomeric polymers as described in EP-A's 0 647 258 and 0 648 254. In this way a ratio by weight of pigment to binding medium of more than 90:10 and more preferably of at least 93:7, e.g. 98:2 can be obtained providing besides an excellent image resolution a high ease of manipulation as a result of a good elasticity of the screen and good adhesion properties between the support and the phosphor layer. Problems concerning staining of screens comprising said rubbery binder(s) may be overcome by the addition of known rubber anti-oxidation compounds. Screen structure mottle can be reduced, further providing a good relation between speed and image definition as disclosed in EP-A 0 758 012 and in the corresponding U.S. Pat. No. 5,663,005. Antistatic properties can be improved by addition of e.g. polyoxyethylene compounds to the surface layers of the screens.

According to the present invention a method of image formation is further obtained by consecutively performing the steps of exposing to X-rays the radiographic screen/film combination or system described hereinbefore; followed by processing the film according to the present invention by the steps of developing, fixing, rinsing and drying.

The said processsing is preferably performed in an automatic processsing machine. More in detail for processing the film material of the present invention, preferably an automatically operating apparatus is used provided with a system for automatic replenishment of the processing solutions. The processing dry-to-dry within a short processing time of from 30 to 90 seconds and more preferably from 30 seconds to less than 60 seconds of materials coated from low amounts of silver is made possible by the steps of developing said material in a developer (preferably) without hardening agent; fixing said material in a fixer, optionally without hardening agent; rinsing and drying said material.

A normally used configuration in the processing apparatus shows the following consecutive tank units corresponding with, as consecutive solutions: developer-fixer-rinse water. Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may als be present. As ecology and low replenishing amounts are main topics with respect to the present invention use is made of concentrated hardener free processing solutions in one single package. Examples thereof have been disclosed e.g. in U.S. Pat. Nos. 5,187,050 and 5,296,342.

Especially preferred developers comprising ecologically acceptable developing agents such as ascorbic acid and derivatives thereof have been described in EP-A 0 732 619 and in U.S. Pat. Nos. 5,593,817 and 5,604,082. Instead of or partially substituting (e.g. in a ratio by weight of from 1:1 up to 9:1) the ecologically questionable "hydroquinone" (iso) ascorbic acid, 1-ascorbic acid and tetramethyl reductic acid are preferred as main developing agent in the developer. Said developing agents which are especially suitable for use, have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure No 371052, published Mar. 1, 1995, wherein a more general formula covering the formula of said developing agents has been represented.

In order to reduce "sludge formation" which is favored by solubilizing agents like sulphites, present in the developer as preservatives, a particularly suitable developer solution is the one comprising a reduced amount of sulphite and ascorbic acid which acts as a main developer and antioxidant as well and which is called "low-sludge" developer. Suitable measures taken therefore have recently been described in the EP-Applications Nos. 99201891 and 99201892, both filed simultaneously Jun. 14, 1999.

Processing cycles wherein no boron compounds are used, are particularly interesting from an ecological point of view as has been described in EP-A 0 908 764 and the corresponding U.S. Pat. No. 6,083,672. So in favour of ecological fixation presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868. A particularly suitable fixer solution comprises an amount of less than 25 g of potassium sulphite per liter without the presence of acetic acid wherein said fixer has a pH value of at least 4.5, in order to make the fixer solution quasi odorless. If however aluminum ions are present in the fixer composition for whatever a reason, the presence of α-ketocarboxylic acid compounds is recommended as has been described in EP-A's 0 620 483 and 0 726 491 as well as in RD 16768, published March 1978. It is possible to use sodium thiosulphate as a fixing agent, thus avoiding the ecologically undesirable ammonium ions normally used. For low coating amounts of emulsion crystals rich in chloride a fixation time which is reduced to about 2 to 10 seconds can be attained. Moreover regeneration is kept to a minimum, especially in the processing of materials coated with reduced amounts of silver halide as in the present invention.

As already set forth hereinbefore single-side coated materials are also envisaged in the present invention, such as in combination with a single screen having luminescent phosphors with a high prompt emission of fluorescent light on X-ray irradiation and low afterglow in favour of image sharpness, suitable for use in mammography, wherefore the relationship between resolution and speed of X-ray intensifying screens has been described e.g. in Med. Phys. 5(3), 205 (1978). Other single-side coated materials wherein the emulsions can advantageously applied, e.g. with respect to preservation properties, developability, etc. are black-and-white silver halide material used e.g. in micrography, in aviation photography, in black-and-white cinefilms, in laser-films or hardcopy films and in graphic or reprographic applications.

As image tone is not a point in colour film materials (as all silver is removed in a bleaching step in the processing) use of those compounds in layers adjacent to light-sensitive layers of multilayered colour materials (like intermediate layers, decolourizable dye filter layers, etc., besides the protective antistress layer, is not recommended, the more as no additional effect can be expected on emulsions having such a low level of iodide ions in the tabular emulsion grains, opposite to e.g. the color materials as described in U.S. Pat. No. 4,740,454 wherein an improved sharpness is envisaged.

While the present invention will hereinafter be described in connection with preferred embodiments thereof, it will be understood that it is not intended to limit the invention to those embodiments.

EXAMPLES

Emulsion E1

1.1. Emulsion Preparation

To a solution of 7.5 g of oxidized gelatin, in 3 l of demineralized water at 25° C., adjusted to a pH of 1.8 by adding $H_2SO_4$ and a pBr of 2.39 by adding a diluted solution of potassium bromide, stirred up to a rate of 700 r.p.m., were added by double jet. Aqueous solutions of 1 M $AgNO_3$ (hereinafter referred to as A1) and 1 M KBr (hereinafter referred to as B1): 25 ml of A1 and 25 ml of B1 were added in a time interval of 30 seconds. After a physical ripening time of 90 seconds the temperature was increased up to 70° C. over a period of 60 minutes. The pH was adjusted to a value of 5, followed by another 3 minutes during which the temperature was held at 70° C. and after which a solution of 50 g of phthalated gelatin in 500 ml of demineralized water of 60° C. was added.

3 minutes later A1 was added at a rate of 7.0 ml/min during 120 seconds, while adding B1 at a rate in order to get a UAg of +40 mV at a temperature of 70° C.

In a double jet addition A1 and B1 were added during a growth step taking 47 min. at a linearly increasing rate going from 7 up to 21.1 ml/min., while adding B1 in order to maintain a constant UAg potential of +40 mV in the reaction vessel. 5 minutes after ending that double-jet addition period, a new double jet addition was started taking 83 min at a lineairly increasing rate going from 10 ml up to 46 ml/min, while adding B1 in order to maintain a constant UAg potential of +30 mV in the reaction vessel.

An amount of an emulsion having ultrafine (ca. 0.040 μm) 100% AgI crystals, was added to the reaction vessel in a time of 2 minutes in order to get a total AgI content at the end of precipitation of 0.3 mole % vs. silver precipitated.

The average grain sizes of the silver bromoiodide tabular {111} emulsion grains thus prepared, have been calculated as follows:

- as average equivalent volume diameter—measured by M öller counting apparatus, expressing volume of each separate grain after electrochemical reduction—a value of 0.57 μm was obtained;
- as average equivalent surface area—measured from electron microscopic photographs—a value of 1.1 μm was obtained;
- as average thickness, measured from shadowed replicas obtained by electron microscopy, a value of 0.095 μm was obtained.

After addition of polystyrene sulphonic acid, followed by decrease of pH in order to flocculate the emulsion, a washing procedure followed by decanting supernatant liquid, and peptization after addition of gelatin, was leading to an emulsion having a weight ratio of gelatin to silver of 0.5 and silver, expressed as an equivalent amount if silver nitrate in an amount of 230 g/kg.

1.2. Chemical Sensitization of Emulsion E1

As spectral sensitizers following compounds 1 and 2 were added per 500 g AgNO3/m2:

Compound 1

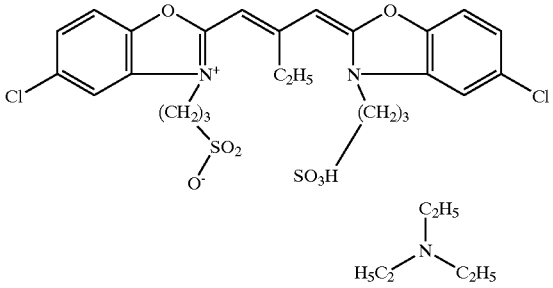

3 g of Compound 1 (as a main spectral sensitizer added in an aqueous solution).

Compound 2

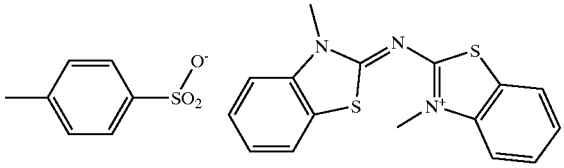

1 g of Compound 2 (as an additional spectral sensitizer)

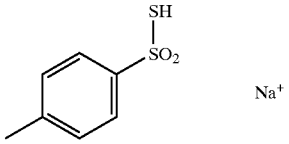

Compound 3 as stabilizing agent was added in an amount of 1 μmole per 500 g of $AgNO_3$.

As Chemical Sensitizers Were Added 0.008 g of a sodium thiosulphate pentahydrate;

11.7 mmole of ammonium gold thiocyanate;

0.4 mmole of KSCN;

0.75 mmole of compound 5, present as sodium salt

Compound 5

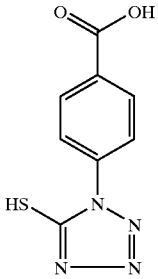

and 0.01 mmole of compound 6

Compound 6

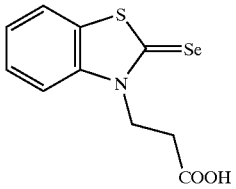

Emulsion E2

2.1. Emulsion Preparation

The emulsion was prepared in the same way as Emulsion A, except for the amount of an emulsion having ultrafine (ca. 0.040 μm) 100% AgI crystals at the end of the preparation: the said emulsion was added to the reaction vessel in a time of 2 minutes in order to get a total AgI content at the end of precipitation of 0.1 mole % vs. silver precipitated.

2.2. Chemical Sensitization of Emulsion E2

As spectral sensitizers same compounds 1 and 2 were added per 500 g silver nitrate, in amounts of 3 g and 0.5 g respectively.

Compound 3 as stabilizing agent, was added in the same amount of 1 μmole per 500 g of $AgNO_3$ as to emulsion A.

0.006 g of a sodium thiosulphate pentahydrate;

17.6 μmole of ammonium gold thiocyanate;

0.4 mmole of KSCN;

0.75 mmole of compound 5, present as sodium salt and 0.025 mmole of compound 6

Coating of the Materials

Per mole of silver nitrate, following compounds were added to the light-sensitive silver halide emulsion layer:

0.09 g of stabilizing compound 7 compound 7

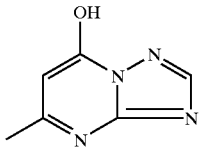

33 mg of stabilizing compound 8 compound 8

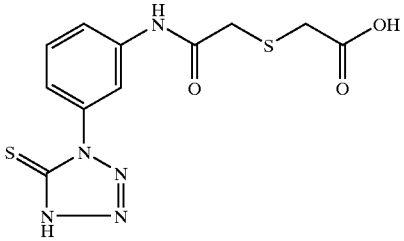

12.6 ml of sorbitol 47 ml of antifoam latex (30% of silicone emulsion in water)

5 ml of surfactant compound 9 (45 ml/l)

compound 9

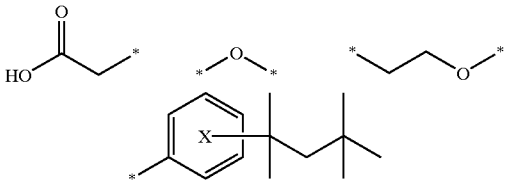

2.8 g of resorcinol hardener—see compound 10;

Compound 10

0.1 g of polyglycol—compound 11;

compound 11

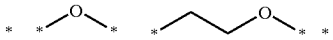

74 ml of dextrane—compound 12—(M.W.10.000)

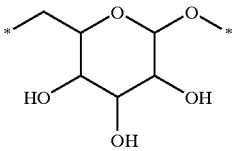

0.2 g of fluoroglucinol—compound 13

Compound 13

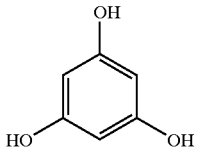

The emulsion coating solutions thus prepared were coated on a blue colored polyethylene terephthalate support (density of the support measured to be 0.200) in such an amount in order to give a coating weight of 2.25 g/m2 per side in terms of AgNO3 and 1.27 g of

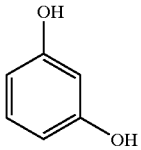

gelatin per m2 per side.

The following protective layer was coated thereupon (pH value: 6.20) at both sides:

Composition of the Protective Antistress Layer per m2:

0.7 g of gelatin 56 mg of antistatic agent—compound 14

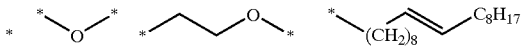

225 mg of latex—compound 15;

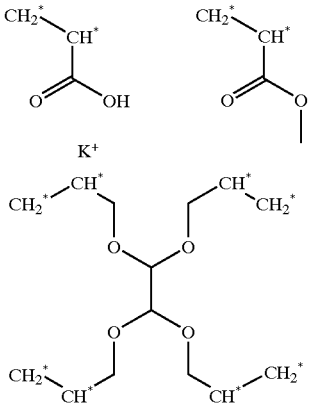

10 mg of surfactant—compound 16;

$F_3C—(CF_2)_6—COOH\ NH_3$

Compound 16

10 mg of stabilizing compound 7 (see above);

1.5 mg of stabilizing compound 17

Compound 17

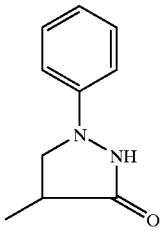

The following protective layer was coated thereupon (pH value: 6.20) at both sides:

Composition of the Protective Antistress Layer per $m^2$:

0.7 g of gelatin 56 mg of antistatic agent—compound 14 (see above)

225 mg of latex—compound 15 (see above);

10 mg of surfactant—compound 16 (see above);

10 mg of stabilizing compound 7 (see above);

1.5 mg of stabilizing compound 17 (as shown above)

Image tone modifying compounds (see figures in the Table)

Compound A

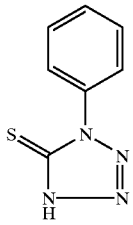

Compound B

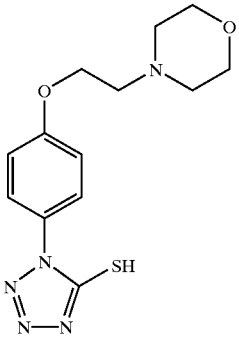

Compound C

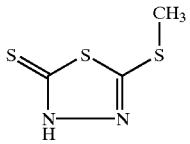

Compound D

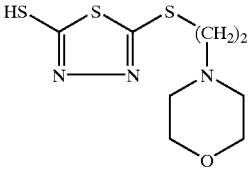

The coating layers of the material were hardened with bis vinyl sulfonyl methyl ether (BVSME) as a hardening agent in order to reduce the swelling degree up to a level of not more than 200% (after swelling for 3 minutes in demineralized water of 20° C.)

Film materials were numbered 1–7: Nos. 1 and 4 were coated in the absence of any of compounds A–D; Nos. 2 and 5 in the presence of compound A; No. 6 in the presence of compound C and Nos. 3 and 7 in the presence of respective compounds B and D, wherein presence of the said compounds B and D in the protective antistress layer of the respective film materials, was providing inventive materials Nos. 3 and 7.

Samples of these coatings were exposed with green light of 540 nm during 0.1 seconds using a continuous wedge and were processed.

The processing was run in the developer G138i, trademarked product from Agfa-Gevaert N.V., Mortsel, Belgium, followed by fixing in fixer G334i, trademarked product from Agfa-Gevaert N.V., Mortsel, Belgium, and rinsing at the indicated temperature of 33° C. for a total processing time of 90 seconds.

Following sensitometric data have been summarized in the Table 1 hereinafter:

Fog "F", given as an integer after having multiplied the real fog density as measured with a factor of 1000;

Speed "S", given as an integer after having multiplied the sensitivity measured at a density of 1.00 above minimum density as measured with a factor of 100;—an decrease of speed with a figure of 30 corresponding with a doubling in speed—;

Image tone "IT", evaluated from figures corresponding with Dr, wherefore data are summarised with respect to the density Dr measured through a red filter at a blue density Db=2: the higher this value (figure multiplied by a factor of 100), the better (more desired blue-black instead of undesired red-brown) is the color of the developed silver.

Differences in speed "ΔS" (fresh material versus after storage for 6 days at 45° C. at 70% RV)

Percentage of "contrast reduction" "% CR" (after storage during 6 days at 45° C. at 70% RV), wherein said "contrast" was measured as an average gradient in the density range between 0.25 and 2.00 above fog.

TABLE 1

| Matl. No. (cmpd) | Em. | mmole/mole of cmpd. | F | S | IT | ΔS | % CR |
|---|---|---|---|---|---|---|---|
| 1 (No) | E1 | — | 200 | 176 | 1.88 | 2 | −11 |
| 2 (A) | E1 | 3.36 | 195 | 184 | 1.92 | −41 | −25 |
| 3 (B) | E1 | 3.36 | 199 | 183 | 1.91 | −9 | −12 |
| 4 (No) | E2 | — | 203 | 171 | 1.90 | 2 | −13 |
| 5 (A) | E2 | 3.36 | 205 | 163 | 1.94 | −87 | −38 |
| 6 (C) | E2 | 3.36 | 190 | 170 | 1.91 | −32 | −25 |
| 7 (D) | E2 | 3.36 | 203 | 168 | 1.92 | −11 | −24 |

Presence of compounds B and D in the inventive materials Nos. 3 and 7 is leading to a better compromise with respect to image tone, and preservation of speed and contrast than the other materials, even in weaker developing conditions.

Having described in detail preferred embodiments of the current invention, it will now be apparent to those skilled in the art that numerous modifications can be made therein without departing from the scope of the invention as defined in the appending claims.

What is claimed is:

1. Black-and-white silver halide photographic film material having first and second major surfaces coated with at least one light-sensitive silver halide emulsion layer overcoated with a protective antistress layer, said emulsion layer(s) having chemically and spectrally sensitised {111} tabular hexagonal emulsion grains or crystals rich in silver bromide in an amount covering at least 50% of the total projective grain surface of all grains, said grains further having an average equivalent volume diameter in the range from 0.3 μm up to 1.5 μm, an average grain thickness of less than 0.30 μm, and an average amount of iodide from 0.05 mole % up to 0.5 mole % based on silver over the whole grain volume, characterized in that said material comprises, in an amount of at least 0.5 mmole per mole of silver halide coated, characterized in that said protective layer, said light-sensitive layer(s) or both said protective layer and said light-sensitive layer(s) comprise, in an amount of at least 0.5 mmole per mole of silver halide coated, a heteroaromatic compound according to general formula (I):

(I)

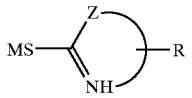

wherein

M represents a hydrogen or an element providing a counterion;

Z represents atoms required in order to form a five-or six-membered heteroaromatic ring; and R represents a substituent representing an amino-ether or amino-alcohol, provided that R is not an azacrown ether;

wherein said amino-ether or amino-alcohol substituents comprise a ternary amine, according to general formula (II):

(II)

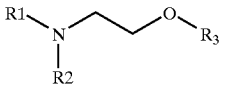

wherein R1 and R2 each independently represents a substituted or unsubstituted aliphatic chain and R3 represents hydrogen or a substituted or unsubstituted aliphatic chain, and wherein each of R1, R2 and R3 may each, independently, form a ring.

2. Material according to claim 1, wherein said heteroaromatic compound is a five membered heteroaromatic compound selected from the group consisting of a tetrazole, a thiadiazole, a triazole, a benz(imidazole), a (benz)thiazole and a (benz)oxazole.

3. Material according to claim 1, wherein said compound is present in the protective antistress layer(s) in an amount between 1 and 5 mmole per mole of silver halide.

4. Material according to claim 1, wherein the tabular grains have an average thickness from 0.05 up to 0.15 μm.

5. Material according to claim 1, wherein said silver halide grains are composed of silver bromoiodide.

6. Material according to claim 5, wherein said silver bromoiodide grains have all silver iodide, present on the grain surface thereof, in order to get an average amount of iodide from 0.05 mole % up to 0.5 mole % based on silver over the whole grain volume.

7. Material according to claim 1, wherein said grains have been made sensitive to the ultraviolet and/or blue range of the wavelength spectrum.

8. Screen/film combination or system comprising a film material according to claim 7, in contact with one supported or self-supported X-ray intensifying screen or sandwiched between a pair of said screens, wherein said intensifying screen or screens comprise(s) luminescent phosphor particles emitting at least 50% of their emitted radiation in the wavelength range for which said material, being a radiographic material, has been made spectrally sensitive.

9. Material according to claim 1, wherein said grains have been made sensitive to green light in the range from 540 up to 570 nm of the wavelength spectrum.

10. Screen/film combination or system comprising a film material according to claim 9, in contact with one supported or self-supporting X-ray intensifying screen or sandwiched between a pair of said screens, wherein said intensifying screen or screens comprise(s) luminescent phosphor particles emitting at least 50% of their emitted radiation in the wavelength range for which said material, being a radiographic material, has been made spectrally sensitive.

11. Material according to claim 1, wherein said compound is present in the protective antistress layer(s) in an amount between 1 and 5 mmole per mole of silver halide.

12. Material according to claim 1, wherein the tabular grains have an average thickness from 0.05 up to 0.15 μm.

13. Material according to claim 1, wherein said silver halide grains are composed of silver bromoiodide.

14. Material according to claim 13, wherein said silver bromoiodide grains have all silver iodide, present on the grain surface thereof, in order to get an average amount of iodide from 0.05 mole % up to 0.5 mole % based on silver over the whole grain volume.

15. Material according to claim 1, wherein said grains have been made sensitive to the ultraviolet and/or blue range of the wavelength spectrum.

16. Screen/film combination or system comprising a film material according to claim 15, in contact with one supported or self-supported X-ray intensifying screen or sandwiched between a pair of said screens, wherein said intensifying screen or screens comprise(s) luminescent phosphor particles emitting at least 50% of their emitted radiation in the wavelength range for which said material, being a radiographic material, has been made spectrally sensitive.

17. Material according to claim 1, wherein said grains have been made sensitive to green light in the range from 540 up to 570 nm of the wavelength spectrum.

18. Screen/film combination or system comprising a film material according to claim 17, in contact with one supported or self-supporting X-ray intensifying screen or sandwiched between a pair of said screens, wherein said intensifying screen or screens comprise(s) luminescent phosphor particles emitting at least 50% of their emitted radiation in the wavelength range for which said material, being a radiographic material, has been made spectrally sensitive.

19. Black-and-white silver halide photographic film material having first and second major surfaces coated with at least one light-sensitive silver halide emulsion layer overcoated with a protective antistress layer, said emulsion layer(s) having chemically and spectrally sensitised {111} tabular hexagonal emulsion grains or crystals rich in silver bromide in an amount covering at least 50% of the total projective grain surface of all grains, said grains further having an average equivalent volume diameter in the range from 0.3 μm up to 1.5 μm, an average grain thickness of less than 0.30 μm, and an average amount of iodide from 0.05 mole % up to 0.5 mole % based on silver over the whole grain volume, characterized in that said material comprises, in an amount of at least 0.5 mmole per mole of silver halide coated, characterized in that said protective layer, said light-sensitive layer(s) or both said protective layer and said light-sensitive layer(s) comprise, in an amount of at least 0.5 mmole per mole of silver halide coated, a heteroaromatic compound according to general formula (I):

(I)

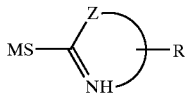

wherein

M represents a hydrogen or an element providing a counterion;

Z represents atoms required in order to form a five- or six-membered heteroaromatic ring; and R represents a substituent representing an amino-ether or amino-alcohol, provided that R is not an azacrown ether;

wherein said material has a laser mark.

20. Screen/film combination or system comprising a film material according to claim 19, in contact with one supported or self-supporting X-ray intensifying screen or sandwiched between a pair of said screens, wherein said intensifying screen or screens comprise(s) luminescent phosphor particles emitting at least 50% of their emitted radiation in the wavelength range for which said material, being a radiographic material, has been made spectrally sensitive.

21. Material according to claim 19, wherein said heteroaromatic compound is a five membered heteroaromatic compound selected from the group consisting of a tetrazole, a thiadiazole, a triazole, a benz(imidazole), a (benz)thiazole and a (benz)oxazole.

22. Material according to claim 19, wherein said amino-ether or amino-alcohol substituents comprise a ternary amine, according to general formula (II):

(II)

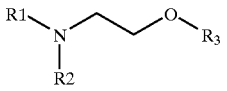

wherein R1 and R2 each independently represents a substituted or unsubstituted aliphatic chain and R3 represents hydrogen or a substituted or unsubstituted aliphatic chain, and wherein each of R1, R2 and R3 may each, independently, form a ring.

23. Material according to claim 19, wherein said compound is present in the protective antistress layer(s) in an amount between 1 and 5 mmole per mole of silver halide.

24. Material according to claim 19, wherein the tabular grains have an average thickness from 0.05 up to 0.15 $\mu$m.

25. Material according to claim 19, wherein said silver halide grains are composed of silver bromoiodide.

26. Material according to claim 25, wherein said silver bromojodide grains have all silver iodide, present on the grain surface thereof, in order to get an average amount of iodide from 0.05 mole % up to 0.5 mole % based on silver over the whole grain volume.

27. Material according to claim 19, wherein said grains have been made sensitive to the ultraviolet and/or blue range of the wavelength spectrum.

28. Material according to claim 19, wherein said grains have been made sensitive to green light in the range from 540 up to 570 nm of the wavelength spectrum.

* * * * *